US011059701B2

(12) United States Patent
Bowling

(10) Patent No.: US 11,059,701 B2
(45) Date of Patent: Jul. 13, 2021

(54) METHODS AND APPARATUSES FOR LIFTING ELEVATOR CARS DURING INSTALLATION

(71) Applicant: thyssenkrupp Elevator Innovation and Operations GmbH, Essen (DE)

(72) Inventor: William E. Bowling, Bloomington, IN (US)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 286 days.

(21) Appl. No.: 16/212,001

(22) Filed: Dec. 6, 2018

(65) Prior Publication Data

US 2020/0180914 A1 Jun. 11, 2020

(51) Int. Cl.

| | |
|---|---|
| ***B66B 19/00*** | (2006.01) |
| ***B66B 11/06*** | (2006.01) |
| ***B66B 11/00*** | (2006.01) |

(52) U.S. Cl.
CPC ..... *B66B 19/00* (2013.01); *B66B 11/005* (2013.01); *B66B 11/06* (2013.01)

(58) Field of Classification Search
CPC ..... B66B 19/00; B66B 11/005; B66B 11/06; F16B 2/00; F16B 2/065; F16B 2/12
See application file for complete search history.

(56) References Cited

U.S. PATENT DOCUMENTS

| | | | | |
|---|---|---|---|---|
| 2,877,974 A * | 3/1959 | Estes | F16B 2/12 | 248/228.3 |
| 3,759,349 A * | 9/1973 | Sieffert | B66B 9/187 | 52/745.2 |
| 5,033,586 A * | 7/1991 | Richards | B66B 9/187 | 187/259 |
| 5,299,661 A * | 4/1994 | Pramanik | B66B 5/044 | 187/373 |

(Continued)

FOREIGN PATENT DOCUMENTS

EP 2206673 A 7/2010

OTHER PUBLICATIONS

Charles E. Adkins, U.S. Department of Labor—OSHA Hazard Information Bulletins—Improper Support of an Elevator Car During Installation, <https://www.osha.gov/dts/hib/hib_data/hib19950622.html>, (Jun. 22, 1995).

(Continued)

*Primary Examiner* — Michael A Riegelman
(74) *Attorney, Agent, or Firm* — William J. Cassin

(57) ABSTRACT

Climber motors are a form of temporary winch that can be used before a permanent elevator drive system is installed at the top of a hoistway. A mount to be employed with such a climber motor may include a frame having a base, a lower portion, and an upper portion. The upper portion may support a lower plate, which lower plate supports sleeves, which sleeves in turn support an upper plate. The frame and the climber motor may be positioned within an elevator cab (Continued)

such that the sleeves extend upwards through apertures in a canopy of the elevator cab. Once the upper plate is positioned between the sleeves and a crosshead above the elevator cab, the climber motor may be engaged to cause the sleeves to exert an upward force on the crosshead and thereby lift the elevator cab in the hoistway.

14 Claims, 5 Drawing Sheets

(56) References Cited

U.S. PATENT DOCUMENTS 7,624,848 B2 * 12/2009 Fischer ..... B66B 19/005 187/250
8,453,800 B2 * 6/2013 Tolonen ..... B66B 5/0056 187/360
8,714,502 B1 * 5/2014 Davis ..... E04B 9/006 248/228.3
8,931,747 B2 * 1/2015 Davis ..... E04B 9/006 248/228.3
8,939,262 B2 * 1/2015 Schienda ..... B66B 5/06 187/287
9,193,567 B2 * 11/2015 Peacock ..... B66B 19/00
2005/0279584 A1 * 12/2005 Reuter ..... B66B 11/0095 187/249
2007/0256899 A1 * 11/2007 Fanielle ..... B66B 19/005 187/408
2012/0279805 A1 * 11/2012 Meyer ..... F03D 80/50 187/261
2015/0083525 A1 * 3/2015 Bruno ..... B66B 19/005 187/254
2016/0137456 A1 * 5/2016 Duvall ..... B66B 5/22 187/359
2016/0311657 A1 * 10/2016 Kilpelainen ..... B66B 19/002
2018/0208438 A1 * 7/2018 Cambruzzi ..... B66B 19/002
2018/0362301 A1 * 12/2018 Lin ..... B66B 11/007
2019/0100419 A1 * 4/2019 Bowling ..... B66F 7/12
2020/0062549 A1 * 2/2020 Kim ..... B66B 11/0045
2020/0180914 A1 * 6/2020 Bowling ..... B66B 11/06
2020/0283271 A1 * 9/2020 Morse ..... B66B 19/005
2020/0377339 A1 * 12/2020 Cambruzzi ..... B66B 19/00

OTHER PUBLICATIONS

Fandom: Elevator Wiki, Overspeed Governor, <http://elevation.wikia.com/wiki/Overspeed_governor>, (Aug. 17, 2018).
Statham et al., Heath & Safety Laboratory, Technical assessment of means of preventing crushing risks on lifts subject to directive 95/16/EC, (2007).
Stanley Elevator Company, Inc., Traction Elevator Modernization, <https://www.stanleyelevator.com/traction-elevator-modernization/>, (2018).
Thyssenkrupp Elevator Technology, Classroom on Demand—Governor Module, <https://www.thyssenkruppelevator.com/webapps/classroom-on-demand/LessonViewer.aspx?lesson=16405>, (2018).
Thyssenkrupp Elevator Technology, Classroom on Demand—Governor <https://www.thyssenkruppelevator.com/webapps/classroom-on-demand/LessonViewer.aspx?lesson=16157>, (2018).

* cited by examiner

METHODS AND APPARATUSES FOR LIFTING ELEVATOR CARS DURING INSTALLATION

FIELD OF THE DISCLOSURE

The present disclosure generally relates to elevators, including methods and apparatuses for lifting elevator cars during installation of elevator systems prior to installment of a permanent elevator machine.

BACKGROUND

A car sling is the basic frame that is used to support a platform and a cab of an elevator. The car sling typically includes a pair of stiles extending vertically alongside the cab, a crosshead that connects the stiles above the cab, and a safety plank that connects the stiles beneath the platform and the cab. Of course the car sling may include other components such as brace rods that provide rigidity to the car sling and extend diagonally between the platform and the stiles, for example.

Furthermore, advantages are known to roping an elevator car at a top, as opposed to a bottom, of a hoistway. Quite often, the car sling is assembled at the bottom of the hoistway and then hoisted by a climber motor, which acts as a form of temporary winch, to the top of the hoistway to be roped. Many elevator manufacturers also use the climber motor to hoist a permanent elevator drive system with the car sling so that the permanent elevator drive system can be installed at the top of the hoistway just prior to roping the car sling. One advantage of using such a climber motor is that a canopy of the cab may serve as a convenient work deck that supports installers as the permanent elevator drive system is secured to a hoist beam, for example, at the top of the hoistway. Notwithstanding, during this part of the elevator installation, best practices require that the car sling be positively supported via multiple, redundant systems at the top of the hoistway to minimize the risk of the car sling dropping.

One known method for roping the car sling and installing the permanent elevator drive system involves positioning a climber motor directly above a crosshead of the car sling. The climber motor thus exerts an upward force on the crosshead to raise the car sling to the top of the hoist way. Yet with this method the climber motor consumes a considerable amount of the limited space on the work deck above the canopy. The climber motor can become even more of an obstacle once the car sling approaches the hoist beam, especially for elevator systems that do not have machine rooms. In some instances, the climber motor can interfere with the hoist beam, preventing the car sling from being positioned at a proper height where the car sling can be roped to the permanent elevator drive system.

Another known method involves attaching the climber motor to the safety plank beneath the car sling. One disadvantage of this approach, however, is that the top of the car sling can become unstable and sway left-and-right and/or back-and-forth. Such instability can become particularly problematic if installers that are supported by the canopy at the top of the car sling are installing guide rails and the like as the car sling is hoisted.

Still another known method involves attaching the climber motor and a bracket, which is used as a point of termination, to the top of the canopy of the cab. A hoist cable may then be secured to a hoist beam at the top of the hoistway. To permit the car sling to be positioned with sufficient proximity to the permanent elevator drive system, the climber motor and the bracket are then removed as the car sling is roped to the permanent elevator drive system. If repairs to the permanent elevator drive system become necessary, though, the climber motor and the bracket must then be reinstalled to suspend the car sling from the hoist beam.

Thus a need exists for methods and apparatuses that enable elevator car slings and other equipment to be lifted and installed in hoistways without the disadvantages described above.

DETAILED DESCRIPTION

Although certain example methods and apparatuses are described herein, the scope of coverage of this patent is not limited thereto. On the contrary, this patent covers all methods, apparatuses, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claim need not necessarily be performed in the order in which they are recited, unless so required by the context of the claims. In addition, all references to one skilled in the art shall be understood to refer to one having ordinary skill in the art.

Figure 1:
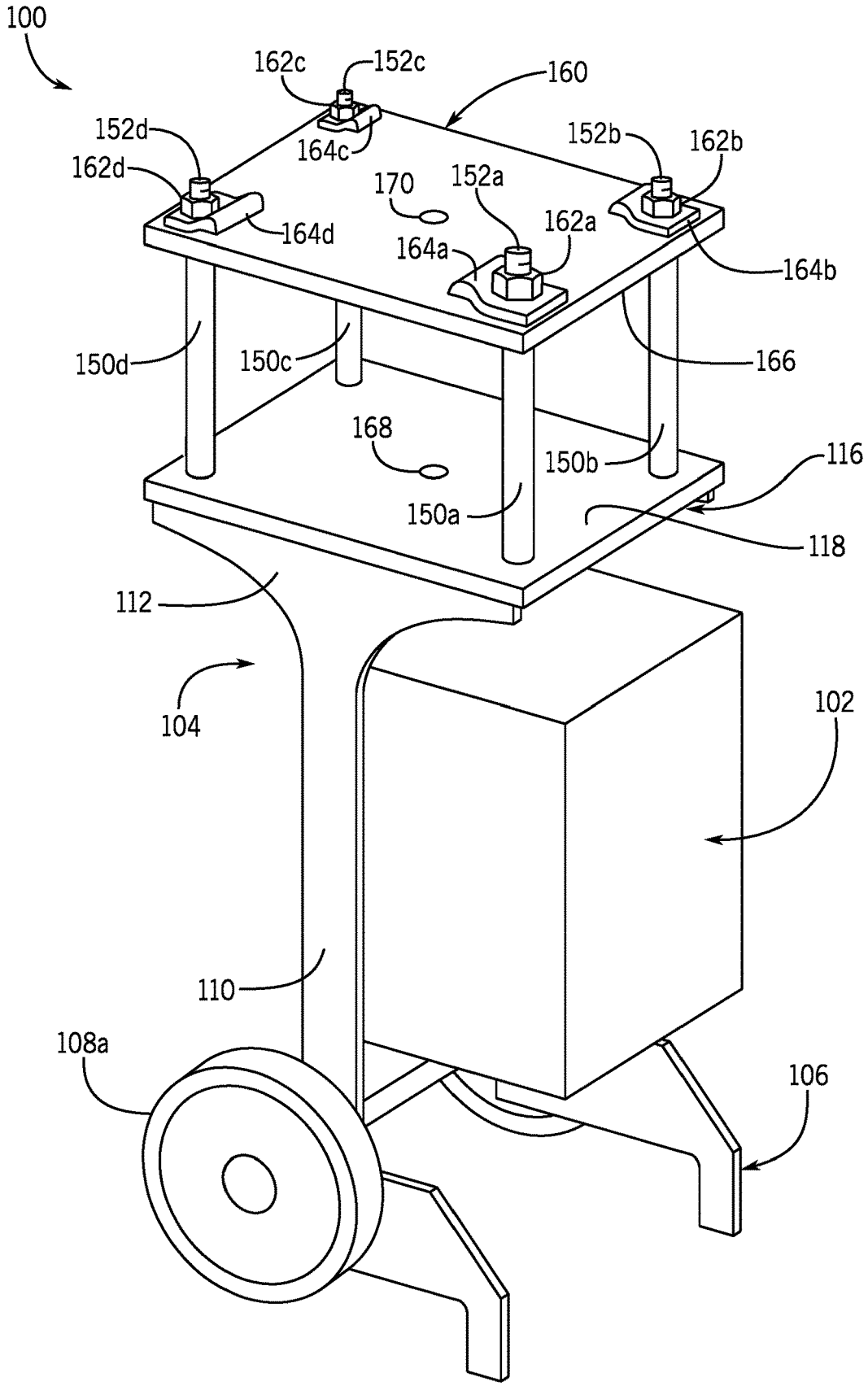
FIG. 1 is a perspective view of an example mount for a climber motor.

Referring now to FIG. 1, in some examples a mount 100 for a climber motor 102 may comprise a frame 104 that is supported by a base 106. In some cases, the frame 104 may also be supported by wheels 108*a*, 108*b* that enhance the transportability of the mount 100. In the example shown in FIG. 1, a lower portion 110 of the frame 104 has a thin, elongated rectangular cross section that extends upward from the base 106. In other examples, the lower portion 110 of the frame 104 may have a completely different configuration, such as a ladder-like configuration or a lattice-like configuration. The lower portion 110 may include a plurality of attachment points, apertures, or the like to which components such as the climber motor 102, for example, can be secured. An upper portion 112 of the frame 104 may include means such as a handle by which the mount 100 can be maneuvered. The upper portion 112 may serve to transition from the lower portion 110 of the frame 104 to a lower plate 116 of the mount 100. The lower plate 116 may be secured in a variety of ways to the upper portion 112 of the frame 104 such as by fasteners or welds, for example.

In some examples, such as that shown in FIG. 1, the mount 100 may include sleeves 150*a*, 150*b*, 150*c*, 150*d* that extend upwards from and are supported by a top surface 118 of the lower plate 116. In still other examples, however, the mount 100 need not necessarily include the lower plate 116, and the sleeves 150*a*, 150*b*, 150*c*, 150*d* may extend upwards from a top surface of the upper portion 112 of the frame 104. Alternatively, the lower plate 116 may be integral with the top surface of the upper portion 112 of the frame 104 such that the top surface of the upper portion 112 of the frame 104 is referred to as a lower plate. Along these lines, the upper portion 112 of the frame 104 may be said to include the lower plate 116. Nonetheless, bolts 152*a*, 152*b*, 152*c*, 152*d* may be positioned within the sleeves 150*a*, 150*b*, 150*c*, 150*d* and may extend downwards through respective apertures in the lower plate 116.

In some examples, the sleeves 150*a*, 150*b*, 150*c*, 150*d* may include bushings or other means for locating the bolts 152*a*, 152*b*, 152*c*, 152*d* centrally within the sleeves 150*a*, 150*b*, 150*c*, 150*d* and/or preventing the bolts 152*a*, 152*b*, 152*c*, 152*d* from rubbing, clanking, or otherwise pressing against the sleeves 150*a*, 150*b*, 150*c*, 150*d*. Further, in some instances, the apertures in the lower plate 116 that receive the bolts 152*a*, 152*b*, 152*c*, 152*d* may be counterbored to help locate and maintain the positions of the sleeves 150*a*, 150*b*, 150*c*, 150*d*. The bolts 152*a*, 152*b*, 152*c*, 152*d* may be secured to the lower plate 116 and/or the upper portion 112 of the frame 104 by way of, for example, nuts. In still other examples, the mount 100 may include a different number of sleeves (e.g., one, two, three, five, six, seven, etc.) and/or different types of sleeves, such as solid sleeves that are welded to either the lower plate 116 and/or the upper portion 112 of the frame 104. As merely one example, a single sleeve may be made large and/or strong enough so that no other sleeves are necessary. The single sleeve could have an internal channel that is big enough to receive a hoist cable. In such an example, an aperture in a canopy of an elevator cab could be sized to accommodate the single sleeve.

With continued reference to FIG. 1, the sleeves 150*a*, 150*b*, 150*c*, 150*d* may support an upper plate 160. The bolts 152*a*, 152*b*, 152*c*, 152*d* may extend through respective apertures in the upper plate 160 and may receive nuts 162*a*, 162*b*, 162*c*, 162*d* and washers 164*a*, 164*b*, 164*c*, 164*d*, for example, during assembly. The apertures in the upper plate 160, particularly with respect to a lower surface 166 of the upper plate 160 that is supported by the sleeves 150*a*, 150*b*, 150*c*, 150*d*, may be counterbored in some cases to help locate and maintain the positions of the sleeves 150*a*, 150*b*, 150*c*, 150*d*.

Moreover, the lower plate 116 may include an aperture 168 configured to receive a hoist cable connected to or configured to be connected to the climber motor 102. The upper plate 160 may also include an aperture 170 configured to receive the hoist cable. As those having ordinary skill in the art will appreciate, the aperture 168 in the lower plate 116 may be aligned vertically with the aperture 170 in the upper plate 160. In some instances, such as where it is desirable to double the lifting capacity of the climber motor 102 by way of 2:1 rigging, for example, the lower and upper plates 116, 160 may each include at least one additional aperture so that a hoist cable may be secured around a hoist beam at a top of the hoistway and back to the mount 100. Yet in other instances, 2:1 rigging may be accomplished by securing the hoist cable to part of a car sling such as a crosshead.

Figure 2:
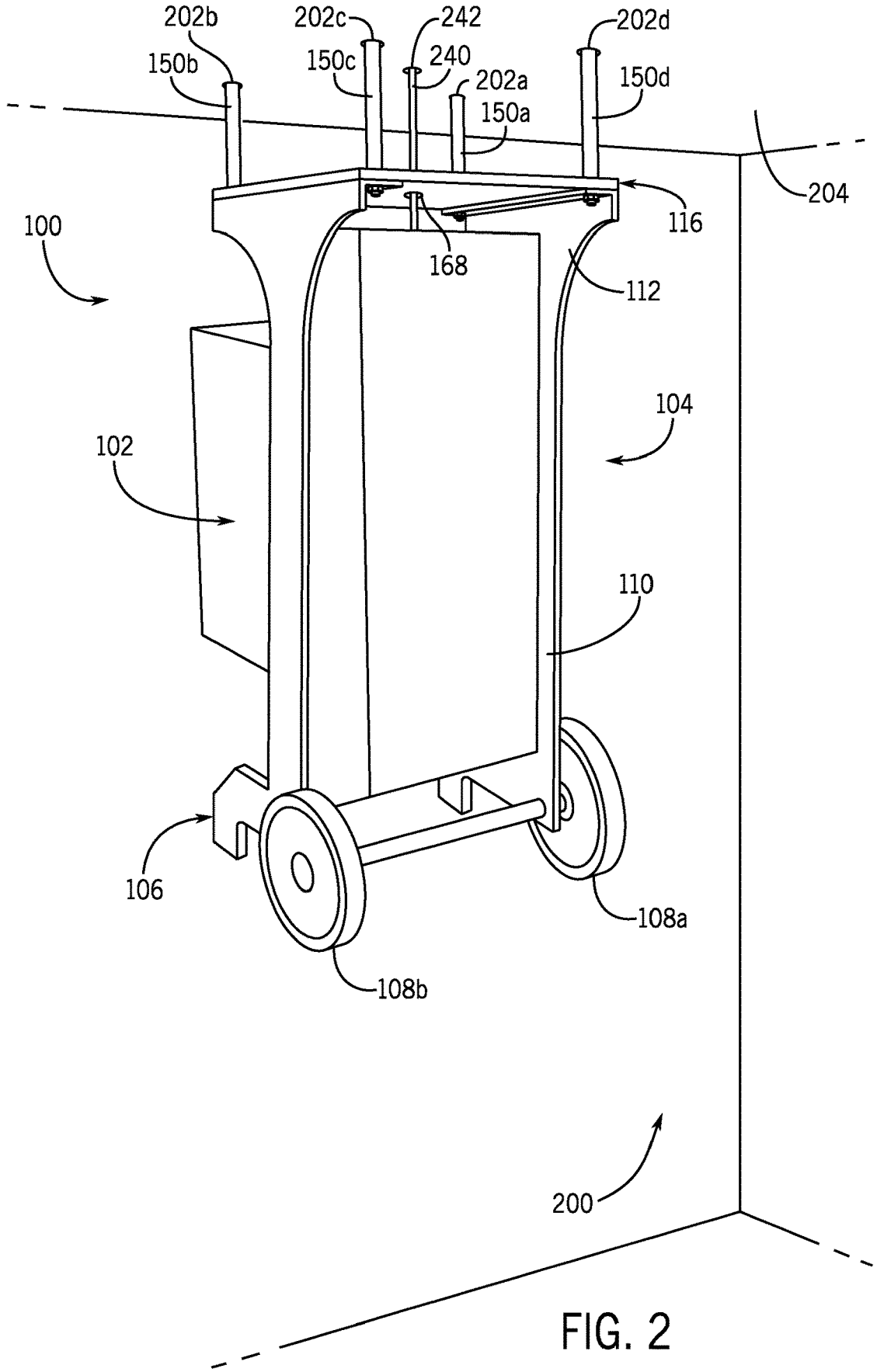
FIG. 2 is a perspective view of the example mount of FIG. 1 extending upwards through a canopy of an elevator cab.

The example mount 100 may be used to lift a car sling, and in some cases other equipment such as a permanent elevator drive system and a machine installation toolkit for installing the permanent elevator drive system, to a top of a hoistway to be roped. In some methods, the mount 100 may be positioned within an elevator cab 200, and the nuts 162*a*, 162*b*, 162*c*, 162*d* and the washers 164*a*, 164*b*, 164*c*, 164*d* may be removed to permit removal of the upper plate 160 from the bolts 152*a*, 152*b*, 152*c*, 152*d*. The mount 100 may then be raised so that the bolts 152*a*, 152*b*, 152*c*, 152*d* and the sleeves 150*a*, 150*b*, 150*c*, 150*d* extend upwards through apertures 202*a*, 202*b*, 202*c*, 202*d* in a canopy 204 of the elevator cab 200, as shown in FIG. 2. It should be understood that in some examples the length of the bolts 152*a*, 152*b*, 152*c*, 152*d* and the sleeves 150*a*, 150*b*, 150*c*, 150*d* may be considerably longer such that the mount 100 may only need to be raised very little to cause the bolts 152*a*, 152*b*, 152*c*, 152*d* and the sleeves 150*a*, 150*b*, 150*c*, 150*d* to extend upwards through the apertures 202*a*, 202*b*, 202*c*, 202*d* in the canopy 204.

Notwithstanding, the present disclosure contemplates a wide variety of ways in which the mount 100 may be raised. For example and without limitation, the mount 100 may be raised manually by installers. The mount 100 may be raised by way of a jack, a lever, a pulley, or a sling. The base 106 or the frame 104 of the mount 100 may include telescoping legs that permit the mount 100 to be raised in a stable manner. Likewise, the present disclosure contemplates a wide variety of ways in which the mount 100 can be held in position once the mount 100 is raised, thereby permitting installers to secure the bolts 152*a*, 152*b*, 152*c*, 152*d* and the sleeves 150*a*, 150*b*, 150*c*, 150*d* as explained below. As one example, a support that rests on a floor of the elevator cab 200 may be slid in underneath the mount 100.

Figure 3:
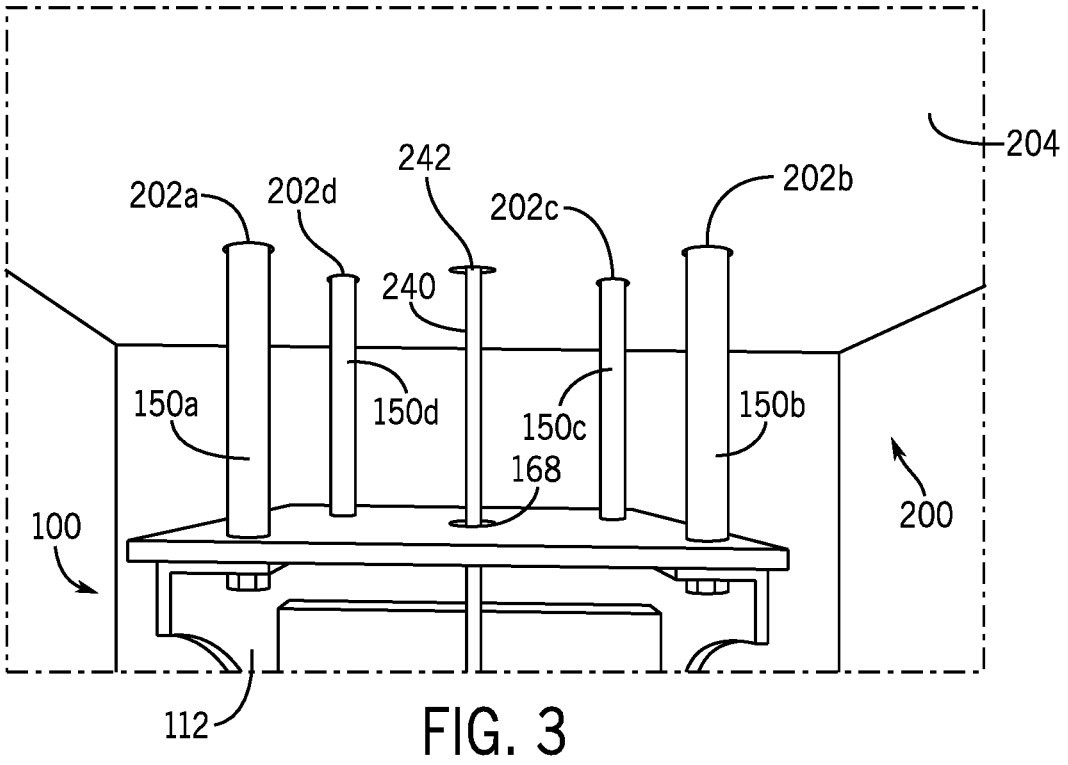
FIG. 3 is a perspective view of example sleeves of the example mount of FIGS. 1-2 and a hoist cable coupled to the climber motor extending upwards through the canopy of the elevator cab.

FIG. 3 shows in more detail how the sleeves 150*a*, 150*b*, 150*c*, 150*d* may be positioned so as to extend through the apertures 202*a*, 202*b*, 202*c*, 202*d* in the canopy 204. Also shown in FIG. 3 is a hoist cable 240 that has been routed to extend through an aperture 242 in the canopy 204. Depending on the climber motor 102 amongst other considerations, in some examples the hoist cable 240 may be routed from the climber motor 102 on the mount 100 up through the canopy 204, whereas in other examples the hoist cable 240 may be routed from above, down through the canopy 204 and secured to the climber motor 102 on the mount 100.

Figure 4:
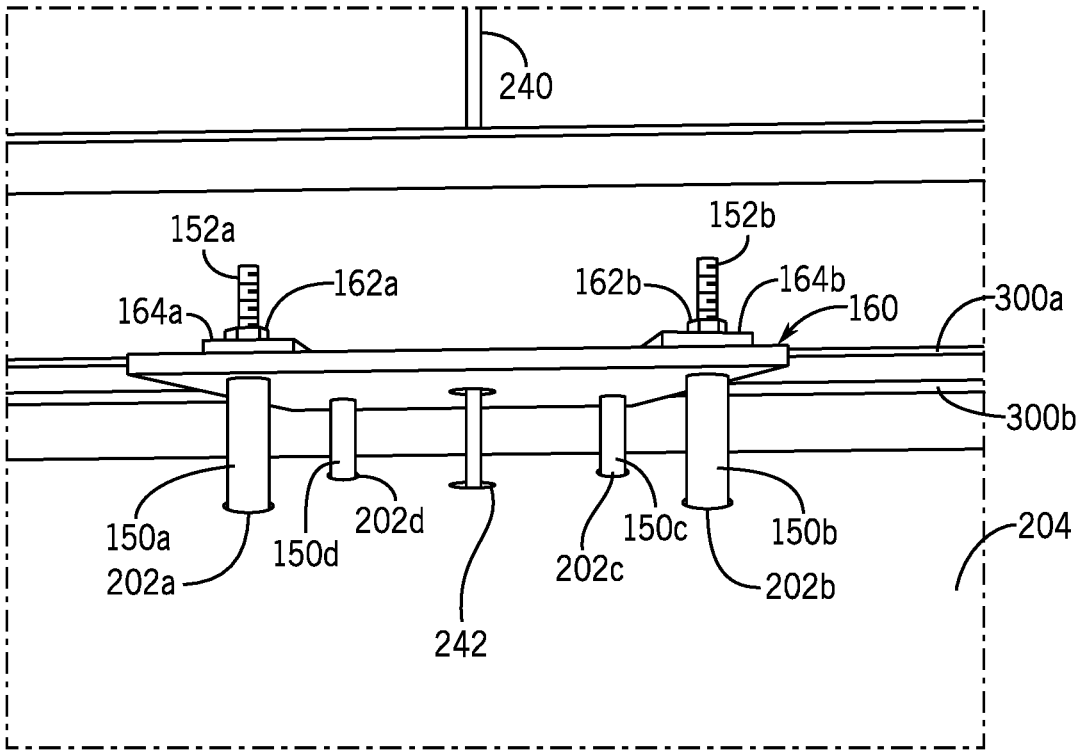
FIG. 4 is a perspective view of the example sleeves of the example mount of FIGS. 1-3 extending above the canopy of the elevator cab and secured to an example crosshead.

FIG. 4 shows one example arrangement of the bolts 152*a*, 152*b*, 152*c*, 152*d* and the sleeves 150*a*, 150*b*, 150*c*, 150*d* above the canopy 204. According to some example methods, once the sleeves 150*a*, 150*b*, 150*c*, 150*d* and the bolts 152*a*, 152*b*, 152*c*, 152*d* are inserted through the apertures 202*a*, 202*b*, 202*c*, 202*d* in the canopy 204, the bolts 152*a*, 152*b*, 152*c*, 152*d* may be guided through corresponding apertures in the upper plate 160 such that the sleeves 150*a*, 150*b*, 150*c*, 150*d* support the upper plate 160. The upper plate 160 and the bolts 152*a*, 152*b*, 152*c*, 152*d*—and the mount 100 generally—may then be secured to a crosshead.

Figure 6:
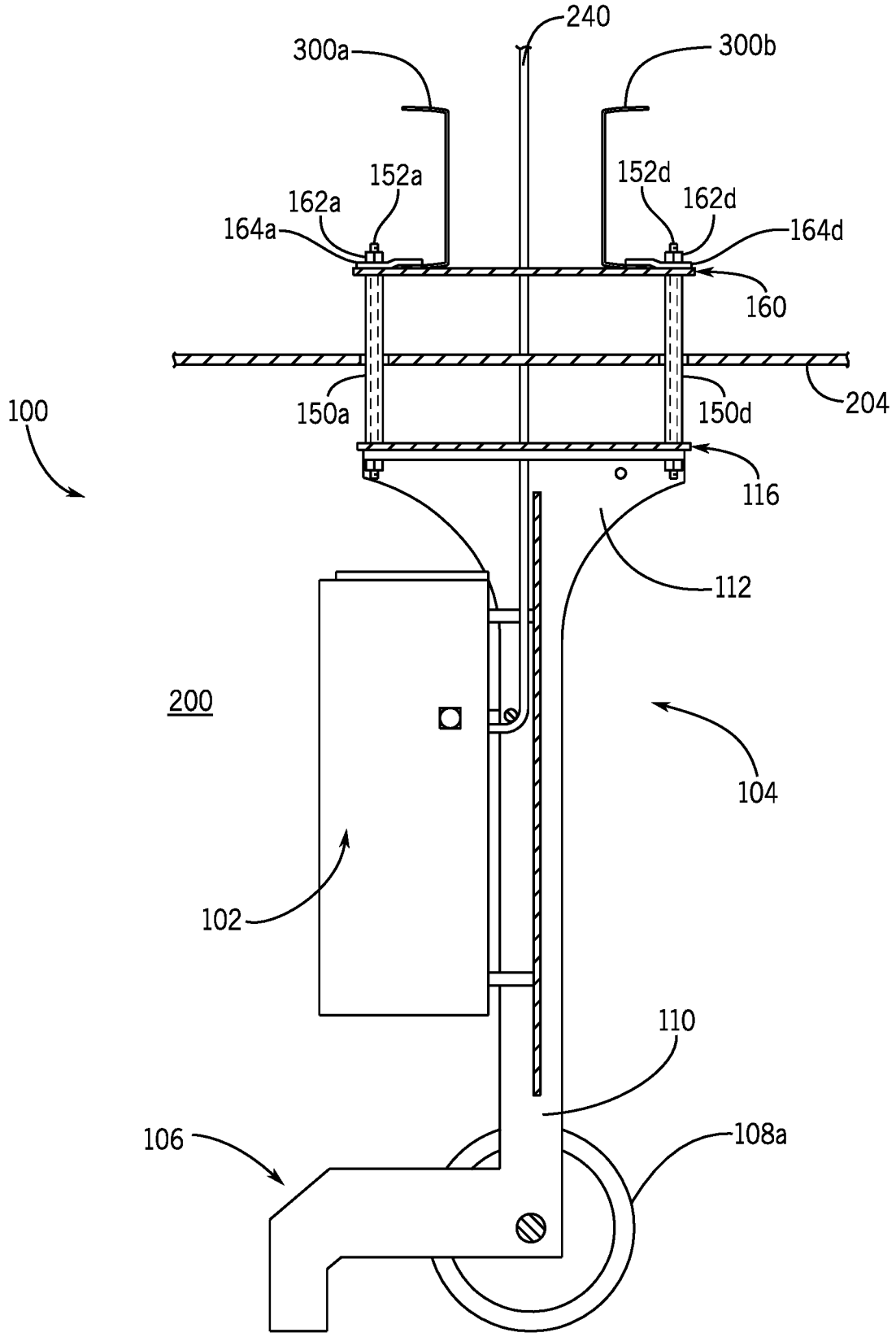
FIG. 6 is a cross-sectional schematic view of the example mount of claims 1-5, which passes through the canopy of the elevator cab and is secured to the crosshead.

In the example shown in the figures, the crosshead of the car sling is a two-part crosshead comprised of a first crosshead 300*a* and a second crosshead 300*b* (shown better in FIG. 6). As also shown in the example in the figures, the crossheads 300*a*, 300*b* may be structural "C" channel beams with "C" shaped cross sections. Those having ordinary skill in the art will understand that in other examples, the car sling may include a different number of crossheads, such as one crosshead or three crossheads, for instance, and/or different types of beams with different cross sections. Nevertheless, FIG. 4 illustrates one example way in which the first crosshead 300*a* may be secured by way of clamping between the upper plate 160 on one side, and the washers 164*a*, 164*b* and the nuts 162*a*, 162*b* on the other side.

Although not shown in FIG. 4, the second crosshead 300*b* may be secured by way of clamping between the upper plate 160 on one side, and the washers 164*c*, 164*d* and the nuts 162*c*, 162*d* on the other side. Lateral movement between the upper plate 160 and the first and second crossheads 300*a*, 300*b* may be prevented by positioning the bolts 152*a*, 152*b*, 152*c*, 152*d* on both sides of the first and second crossheads 300*a*, 300*b*. Consequently, the mount 100 is secured to the crossheads 300*a*, 300*b* of the car sling, and the hoist cable 240 can be routed between the first and second crossheads 300*a*, 300*b* to a hoist beam at the top of the hoistway. It should be understood that the bolts 152*a*, 152*b*, 152*c*, 152*d* and/or the sleeves 150*a*, 150*b*, 150*c*, 150*d* may be secured to a crosshead in a many different ways. By way of example, one example crosshead may include corresponding apertures through which the bolts 152*a*, 152*b*, 152*c*, 152*d* extend. Some example crossheads may even have apertures in both the lower and upper lateral portions for receiving the bolts 152*a*, 152*b*, 152*c*, 152*d*.

Figure 5:
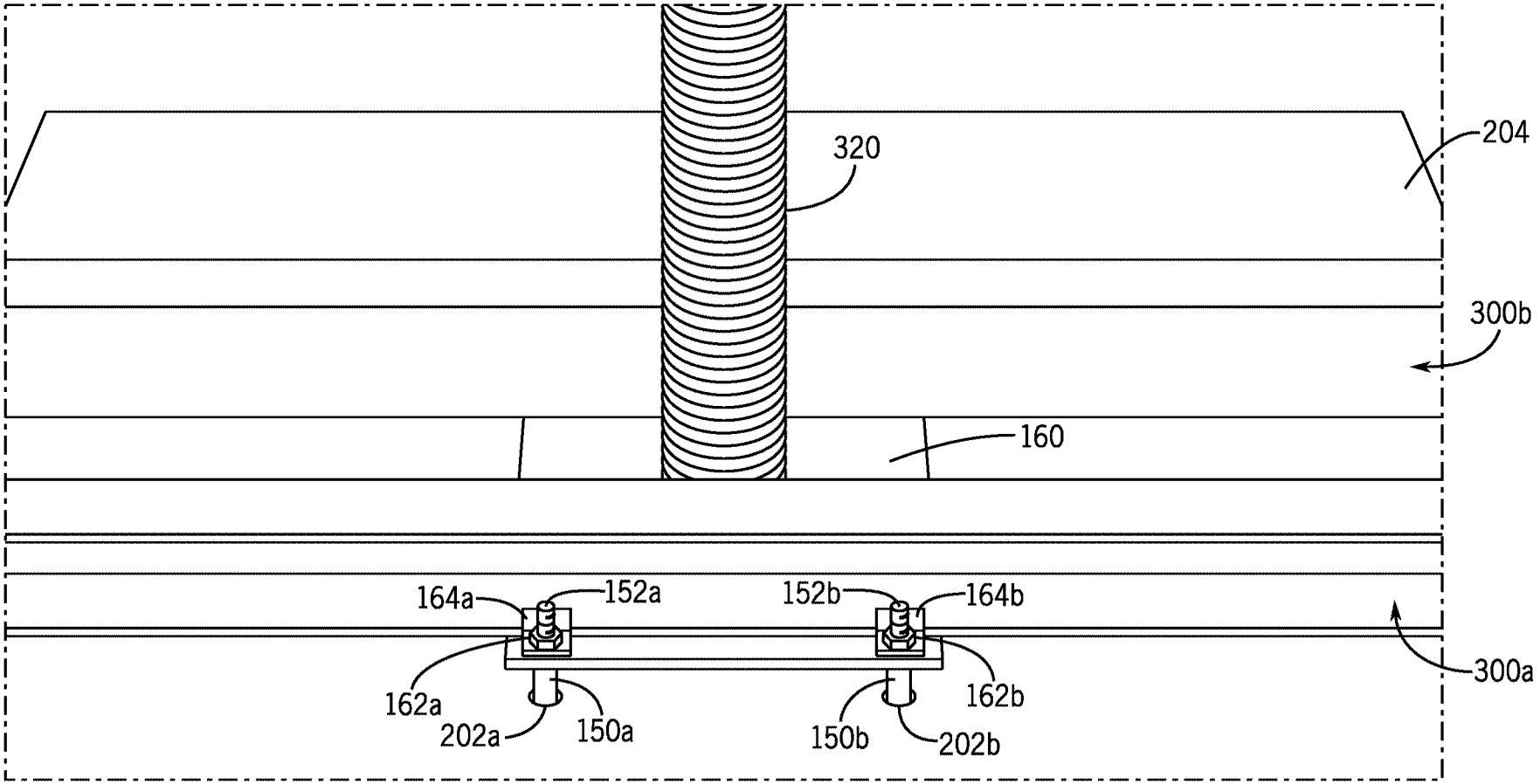
FIG. 5 is a perspective view of the example mount of FIGS. 1-4 secured to the crosshead, with an example guard disposed around the hoist cable that extends upwards to a top of a hoistway.

FIG. 5 provides another perspective view above the canopy 204, after the mount 100 has been secured to the first and second crossheads 300*a*, 300*b*. In FIG. 5, moreover, an example guard 320 has been placed around the hoist cable 240 to protect the hoist cable 240 during certain parts of the elevator installation process.

FIG. 6 is a cross-sectional schematic view of the example mount 100 attached to the first and second crossheads 300*a*, 300*b* of the car sling. One having ordinary skill in the art will appreciate how forces are transmitted throughout the mount 100 and the crossheads 300*a*, 300*b* as the climber motor 102 hoists the mount 100 and the car sling and hence the elevator cab 200 towards a hoist beam to which the hoist cable 240 may be secured at the top of the hoistway. The climber motor 102 exerts a force onto the lower portion 110 of the frame 104, which is transferred upwards towards the upper portion 112 of the frame 104 and the lower plate 116. The lower plate 116 pushes upwards on the sleeves 150*a*, 150*b*, 150*c*, 150*d*, which in turn push upwards on the upper plate 160. Because the upper plate 160 is secured to the crossheads 300*a*, 300*b*, the upper plate 160 exerts an upward force on the crossheads 300*a*, 300*b*. When the upward force exerted by the mount 100 and the climber motor 102 overcome their own weight and the weight of the car sling, amongst other forces acting against movement, the car sling accelerates and begins moving upward.

Although FIGS. 1-6 and the above text disclose various example apparatuses and various example methods, those having ordinary skill in the art will recognize that the example apparatuses and example methods referenced herein may be modified in a multitude of ways without departing from the scope of the present disclosure.

What is claimed is:

1. A mount for a climber motor that hoists an elevator cab within a hoistway, the mount comprising:

a frame configured to receive the climber motor, the frame having a lower portion that is supported by a base and an upper portion that is supported by the lower portion;

a lower plate that is integral with or supported by the upper portion of the frame, the lower plate configured to be positioned beneath a canopy of the elevator cab while the climber motor lifts the elevator cab in the hoistway; and a sleeve that is supported by the lower plate, wherein the sleeve is configured to extend through the canopy and exert an upward force on a crosshead above the canopy of the elevator cab while the climber motor lifts the elevator cab in the hoistway.

2. The mount of claim 1 comprising an upper plate that is supported by the sleeve, wherein the upper plate is configured to be positioned directly underneath the crosshead while the climber motor lifts the elevator cab in the hoistway.

3. The mount of claim 1 wherein the sleeve includes an internal channel for receiving a hoist cable.

4. The mount of claim 1 comprising an upper plate that transfers the upward force from the sleeve to the crosshead while the climber motor lifts the elevator cab in the hoistway, wherein the upper plate includes an aperture configured to receive a hoist cable coupled to the climber motor.

5. The mount of claim 1 wherein the sleeve is a first sleeve, the mount comprising a second sleeve and an upper plate that is supported by the first and second sleeves, wherein the upper plate is configured to be secured to the crosshead while the climber motor lifts the elevator cab in the hoistway.

6. The mount of claim 5 comprising a first bolt disposed within the first sleeve and a second bolt disposed within the second sleeve.

7. The mount of claim 6 wherein the first and second bolts facilitate a clamping connection of the crosshead while the climber motor lifts the elevator cab in the hoistway, wherein the crosshead is clamped between the first sleeve and a first nut, wherein the crosshead is clamped between the second sleeve and a second nut.

8. A mount for a climber motor that hoists an elevator cab within a hoistway, the mount comprising:

a frame configured to receive the climber motor, the frame having a lower portion that is supported by a base and an upper portion that is supported by the lower portion;

a lower plate that is integral with or supported by the upper portion of the frame, the lower plate being positionable within the elevator cab while the climber motor lifts the elevator cab in the hoistway;

an upper plate that is positionable underneath a crosshead above the elevator cab while the climber motor lifts the elevator cab in the hoistway; and sleeves disposed between the upper and lower plates, wherein the sleeves are configured to extend through apertures in the canopy and exert an upward force on the upper plate above the canopy of the elevator cab while the climber motor lifts the elevator cab in the hoistway.

9. The mount of claim 8 wherein the sleeves comprise a first sleeve, a second sleeve, a third sleeve, and a fourth sleeve, wherein the first, second, third, and fourth sleeves are disposed in a rectangular pattern.

10. The mount of claim 9 comprising first, second, third, and fourth bolts disposed, respectively, within the first, second, third, and fourth sleeves.

11. The mount of claim 10 wherein the first, second, third, and fourth bolts extend through corresponding apertures in the lower plate and through corresponding apertures in the upper plate.

12. The mount of claim 11 wherein the first, second, third, and fourth bolts facilitate a clamping connection of the crosshead while the climber motor lifts the elevator cab in the hoistway, wherein the crosshead is clamped between the first, second, third, and fourth sleeves and corresponding nuts that mate with the first, second, third, and fourth bolts.

13. The mount of claim 11 wherein the first and second bolts are configured to be secured to a first member of the crosshead while the climber motor lifts the elevator cab in the hoistway, wherein the third and fourth bolts are configured to be secured to a second member of the crosshead while the climber motor lifts the elevator cab in the hoistway.

14. The mount of claim 8 wherein the upper and lower plates include vertically-aligned apertures that are configured to receive a hoist cable of the climber motor.

* * * * *